United States Patent [19]

Blakesley

[11] 4,373,262

[45] Feb. 15, 1983

[54] ELECTRICAL CONTACT WITH LOCKING DEVICE

[75] Inventor: Roland F. Blakesley, Canton, Ohio

[73] Assignee: The Bendix Corporation, Southfield, Mich.

[21] Appl. No.: 183,549

[22] Filed: Sep. 2, 1980

Related U.S. Application Data

[62] Division of Ser. No. 74,637, Sep. 12, 1979, Pat. No. 4,278,313.

[51] Int. Cl.[3] ..... H01R 43/04

[52] U.S. Cl. ..... 29/882; 29/874; 339/252 P

[58] Field of Search ..... 29/874, 882, 869, 870; 72/339, 367; 113/116 UT; 339/252 P, 17 R, 47 R, 49 R

[56] References Cited

U.S. PATENT DOCUMENTS

| | | | |
|---|---|---|---|
| 3,252,127 | 5/1966 | Woodward | 339/217 J |
| 3,588,789 | 6/1971 | Kailus | 339/217 S |
| 3,693,140 | 9/1972 | Nijman | 339/252 P |
| 4,017,142 | 4/1977 | Clark et al. | 339/17 R X |

*Primary Examiner*—Francis S. Husar
*Assistant Examiner*—Carl J. Arbes
*Attorney, Agent, or Firm*—Paul J. Ethington; Charles D. Lacina; Raymond J. Eifler

[57] ABSTRACT

A method of making a hermaphroditic electric contact including steps of forming a tubular body with fingers having offset blade portions extending longitudinally from one end portion of the body, bending the blade portions to face radially inwardly of the body, cutting openings in the body to form medial wall portions, forcing the opposite ends of the tube together and allowing the wall portions to bend outwardly and form U-shaped locking shoulders, the locking shoulders being axially compressible during twisting fitment of the contact into a retention shoulder formed in a connector passage.

1 Claim, 9 Drawing Figures

Fig-1
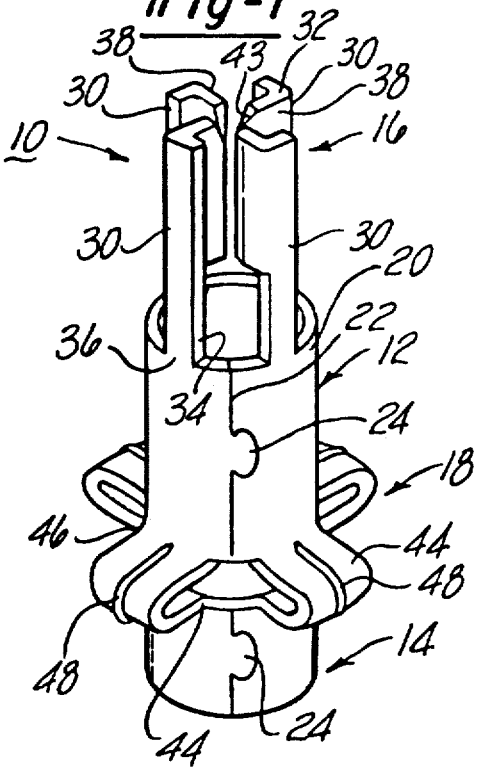
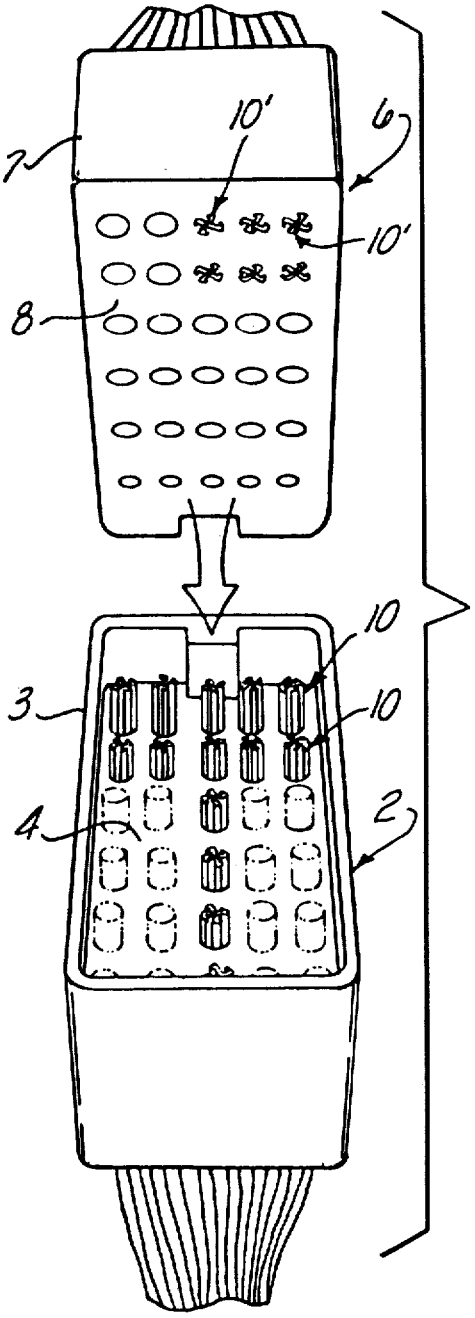
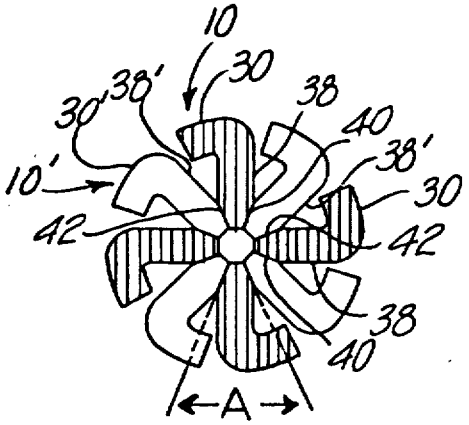
Fig-3
Fig-2

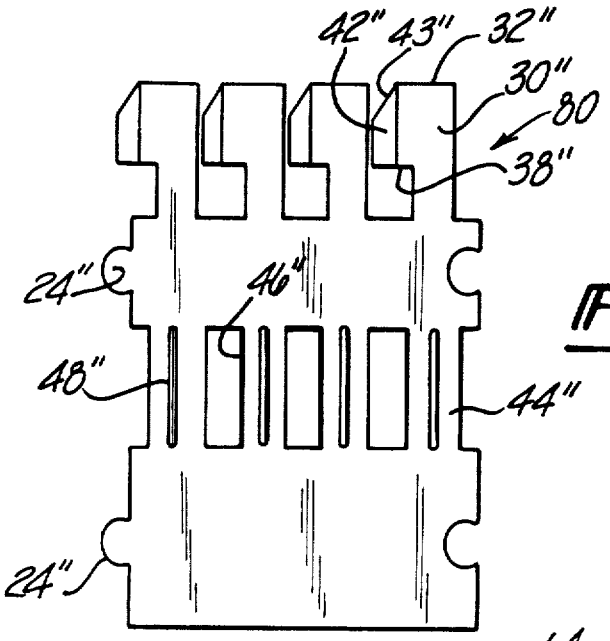
Fig-4
Fig-5
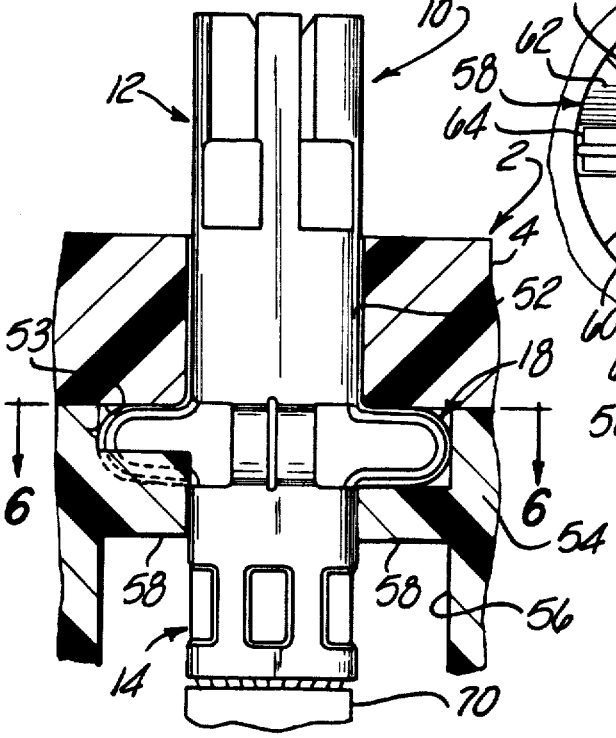
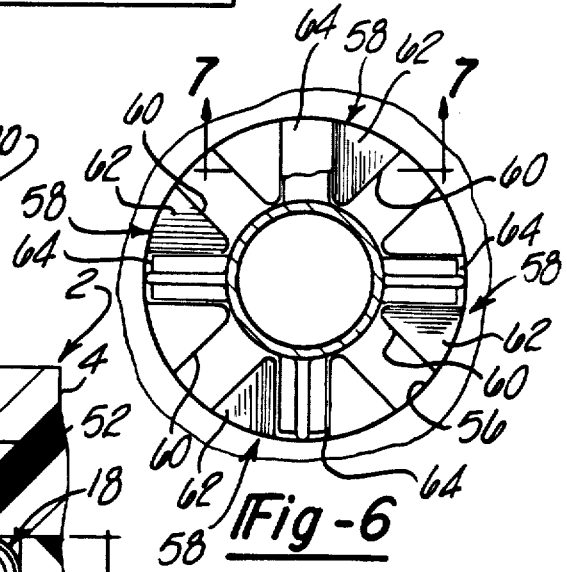
Fig-6

ELECTRICAL CONTACT WITH LOCKING DEVICE

This invention is a division of parent application Ser. No. 74,637, filed Sept. 12, 1979 now U.S. Pat. No. 4,278,313.

TECHNICAL FIELD

This invention relates to electrical connectors of the plug and receptacle type; more particularly it relates to hermaphrodite contacts for such connectors.

BACKGROUND OF THE INVENTION

Electrical connectors of the plug and receptacle type are used in many applications for connecting one pair or multiple pairs of corresponding wires. The wires at the receptacle are connected to individual terminals and the wires at the plug are connected to corresponding terminals. Each of the terminals comprises an electrical contact having a wire receiving end and a mating end. The mating end of corresponding contacts are matingly engaged to provide electrical continuity therebetween when the plug and receptacle are connected together. It is known in the prior art to use electrical contacts of the hermaphroditic type, i.e. the mating ends of the corresponding contacts are of identical structure. Hermaphroditic contacts are advantageous in that identical contacts are used on both the plug and receptacle and hence there is economy in manufacture and field service. However, in the prior art, there have been difficulties in making hermaphroditic contacts at low cost which provide good electrical connection together with low insertion force which is especially important in multiple contact connectors.

An important application for hermaphroditic contacts is that of miniaturized connectors such as those used in aerospace electronic systems. In such connectors, the contacts need to be very small; for example a contact may be about one tenth inch diameter and about one-half inch long. Typically, miniature contacts have been of the pin and socket type. When miniature pin and socket contacts were first introduced, they were manufactured by machining from metal stock in order to hold the tolerances required for the mating contacts. In recent years, such contacts have been made from sheet metal by stamping and rolling to produce the so-called "formed" contact. Formed contacts comprise a tubular assembly having a wire receiving end and a mating end and a mounting or locking shoulder therebetween. The mating end of the socket contact is provided with plural cantilevers or contact fingers adapted to receive the pin contact. A contact of this construction and the method of making it are described in U.S. Pat. No. 4,072,394 to Waldron, et al. and assigned to the same assignee as this application.

In the prior art, hermaphroditic contacts are known in which each contact comprises a single blade having a slot defined by shaped edges and extending rearwardly from the free or mating end of the blade. A pair of such contacts are placed in mating engagement by orienting the respective blades in perpendicular planes with the slots aligned and inserting one blade over the other in telescoping relationship. One difficulty with this device is that the blades are unyielding in the plane of the blades and good electrical contact cannot be obtained without high insertion force.

In the prior art connectors, it is known to use contacts which are insertable and removable in the body of the connector to facilitate initial hook-up and servicing of a connector. Typically, the contact is provided with an annular mounting or locking shoulder intermediate the wire receiving and the mating ends which coacts with a retention member in the connector. The retention member has plural resilient fingers which flex to allow insertion of the contact and which seat behind the locking shoulder to hold the contact in place. The contact is removable with the aid of a special tool for deflecting the fingers from the locking shoulder. A contact of this type is disclosed in U.S. Pat. No. 4,082,398 to Bourdon et al.

A general object of this invention is to provide an improved electrical contact of hermaphroditic type and also to provide an improved locking arrangement for an insertable and removable contact.

DISCLOSURE OF THE INVENTION

According to this invention, an hermaphrodite contact is provided which exhibits good electrical connection and low insertion force. This is accomplished by a contact having a tubular body with plural contact fingers extending axially thereof each having a radially extending blade for engagement with complementary blades of a mating contact. Preferably, the radially inwardly extending blade of each finger is terminated in bevelled edges which form a wedge and the plural fingers are space equiangularly with the spacing between adjacent blades such that the complementary blades of an identical mating contact fit therebetween with the bevelled edges in face-to-face engagement. The tubular body has a cylindrical wall of spring metal and each finger is a cantilever separated from each adjacent finger by axial slots in the wall. The end of each blade is tapered with an oblique section extending from the inner edge of the blade to the end thereof to facilitate entry of one mating contact into the other. Preferably, the contact is fabricated from flat sheet metal as a formed contact.

Further, according to the invention an insertable and removable contact is provided with locking means which ensures retention of the contact in a supporting member. This is accomplished by providing the contact with resilient locking shoulders each of which is formed as a U-shaped leaf spring extending outwardly from the tubular body of the contact.

A more complete understanding of this invention may be obtained from the detailed description that follows taken with the accompanying drawings.

DESCRIPTION OF THE DRAWINGS

FIG. 1 is a perspective view of a contact according to this invention,

FIG. 2 is an exploded view of an electrical connector including multiple contacts according to this invention, FIG. 3 is a sectional view of a pair of mating contacts according to this invention, FIG. 4 shows a sheet metal blank from which the contact is formed, FIG. 5 shows the contact of this invention installed in a connector member, FIG. 6 is a view taken on lines 6—6 of FIG. 5.

BEST MODE FOR CARRYING OUT THE INVENTION

Figure 7:
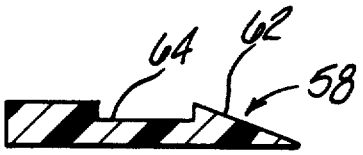
FIG. 7 is a view taken on lines 7—7 of FIG. 6.

Referring now to the drawings, there is shown an illustrative embodiment of the invention in an hermaphrodite contact especially adapted for use in separable electrical connectors. The contact is adapted to be mounted in a dielectric insert of an electrical connector member, such as a plug or socket. The contact is of the formed type, i.e. it is fabricated from thin sheet metal by stamping and rolling. As the description proceeds, it will be appreciated that the invention is useful in other embodiments.

The contact 10 is shown in FIG. 1. In general, it comprises a tubular body 12 having a wire receiving end 14 and a mating end 16. The tubular body is provided with a locking means 18 which is adapted to lock the contact in a supporting member.

FIG. 2 shows an electrical connector of the type in which the subject invention may be used. The electrical connector comprises a plug 2 having a shell 3 which contains a plate 4 of dielectric material in which are mounted a plurality of contacts 10. The electrical connector also includes a receptacle 6 having a shell 7 which contains a plate 8 of dielectric material on which are mounted a plurality of contacts 10', which are identical to contacts 10. The plug 2 and the receptacle 6 are adapted to be oriented and drawn together in a mated relationship. Each contact 10 on the plug 2 is in positional correspondence with a contact 10' on the receptacle 6 so that corresponding pairs of contacts are engaged in mating relation with each other when the receptacle and plug are drawn together.

Referring again to FIG. 1, the contact 10 will be described in detail. The tubular body 12 comprises a cylindrical wall 20 of spring metal, such as beryllium copper. The tubular body is formed by stamping and rolling a flat metal sheet, as will be described subsequently, and includes a seam 22 which defines a pair of interlocks 24.

The mating end 16 of the tubular body 12 comprises a set of four identical contact fingers 30 which are spaced equiangularly around the circumference of the cylindrical wall 20. Each of the contact fingers 30 extends integrally from the wall 20 in an axial direction. Each contact finger 30 is a cantilever having an attachment or root 36 integral with wall 20 and having a free end 32 which is flat. Each finger is separated from each adjacent finger by an axial slot 34 in the cylindrical wall 20. Each contact 30 includes a radially extending blade 38 which extends from the free end 32 to a point intermediate the free end and the root 36 of the finger. Each blade 38, as best shown in FIG. 3, terminates in bevelled edges 40 and 42 which form a wedge, with a wedge angle A, on the inner edge of the blade. The edge of the blade at the free end has an oblique section 43. The contact fingers 30 and blades 38 are substantially parallel or slightly convergent with each other toward the mating end 16. The tubular body is adapted to receive the stripped end of a wire 70 (see FIG. 5) inside the tubular body and the wire is suitably affixed to the contact by crimping.

FIG. 3 shows identical contacts 10 and 10' in mating engagement. In this condition the fingers 30 of contact 10 are interdigitated with fingers 30' of contact 10'. It is noted that the space between the bevelled edges 40 and 42 of a pair of adjacent blades 38 is the same shape and size as that between the bevelled edges 40 and 42 of the same blade. In other words, the blades 28 are spaced on each contact 10 so that each blade 38' of an identical contact 10' will fit between an adjacent pair of blades 38 with the bevelled edges in face-to-face engagement. The oblique section 43 on each blade facilitates entry of the blades of one contact into the other. With the contacts oriented at an angle of 45° relative to each other, the contacts may be pushed together without end-to-end interference. The bevelled edges coact in a wedging engagement which provides a large surface area of engagement of the contacts.

The locking means 18 comprises a plurality of radially extending shoulders 44 each of which is integral with the wall 20 of the tubular body 12. Each shoulder 44 is U-shaped in cross-section and forms an inwardly opening channel extending circumferentially of the tubular body 12 forming an enlargement thereof. It is noted that each shoulder 44 is separated from the adjacent shoulder by a window or slot 46 in the wall 20 of the tubular body 12. Each of the shoulders 44 constitutes a leaf spring which extends outwardly of the body and which is adapted to flex along the axial direction of the tubular body 12. A stiffening rib 48 extends longitudinally of the shoulder 44.

FIGS. 5 and 6 show a single contact 10 installed in plug 2. The dielectric plate 4 has a passage 52 extending therethrough which receives the mating end 12 of the contact and provides an abutment surface 53. A contact retention plate 54 is disposed behind the dielectric plate 4 and is affixed relative thereto in the shell 3 of the plug. The retention plate 54 is provided with a passage 56 which is circular in cross-section and coaxially aligned with passage 52. As shown in FIG. 6, a set of four platforms 58 extend radially into the passage 56 to provide a support for the shoulders 44 on the contact. The platforms 58 are spaced equiangularly and are separated from each other by slots 60 which are wide enough to allow the shoulders 44 to pass therethrough. As best shown in FIGS. 6 and 7, each platform comprises a ramp 62 and an adjacent groove 64 in the forward surface of the platform. The groove is wide enough to receive one of the shoulders 44. The contact 10, after being mounted on the end of a wire 70, is inserted into the passage 56 with the shoulders 44 aligned with the slots 60 and the forward ends of the shoulders 44 are seated against the abutment surface 54 of the dielectric plate 4. The contact 10 is pushed forwardly and rotated in a clockwise direction so that the rear ends of the shoulders 44 engage the ramps 62. This causes the resilient shoulders 44 to flex or compress in the axial direction allowing rotation of the contact until the shoulders are aligned with the respective slots 64. In this position, the shoulders will drop into the slots 64 and lock the contact in place. The contact 10 may be removed by pressing forwardly on the wire receiving end 14 to flex or compress the resilient shoulders 44 so that they clear the edges of the slots 64. Then the contact is rotated in a counterclockwise direction until the shoulders 44 are aligned with the slots 60 and then the contact is withdrawn through the passage 56. The contacts 10' are mounted in the receptacle 6 in the same manner as in the plug 2.

When the plug 2 and receptacle 6 are connected in mating relationship, the corresponding pairs of contacts 10 and 10' are placed in mating engagement. Each contact 10 is mounted in an orientation of 45° relative to the contact 10′ to align the contact fingers in mating relationship. As described above, the mating relationship of the contact fingers of a pair of contacts 10 is shown in FIG. 3.

The contact 10 is preferably fabricated as a formed contact by a stamping and rolling process. FIG. 4 shows a contact blank 80 which has been stamped from sheet metal for forming the contact 10. The contact blank, as shown in FIG. 4, is flat and the parts thereof which correspond to like parts shown in FIG. 1 are identified by a reference character of the same number with a double prime symbol. It is noted that the bevelled edges 40″ and 42″ are formed with the blank in the flat condition. Also while the blank is flat, the blades 38″ are bent to a position perpendicular to the flat portion of the fingers 30″. In this condition, the blank is rolled to form the tubular body with the edges abutting at the seam 22″ and the interlocks 24″. If desired, strengthening ribs 48″ are embossed into the shoulder 44″. The shoulders are formed by applying an axial force on the tubular body to partially collapse and bow outwardly the shoulders 44″ to bend the shoulders 44 into a U-shaped or channel-shaped cross-section. The contact fingers 30 are preformed substantially parallel to each other or with a slight convergence toward the free ends 32.

Figure 8:
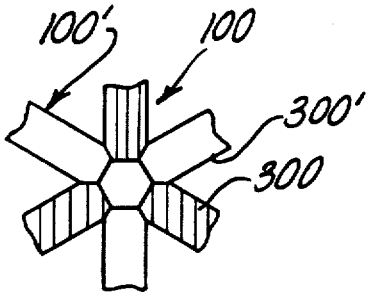
FIG. 8 shows another embodiment of the invention.
Figure 9:
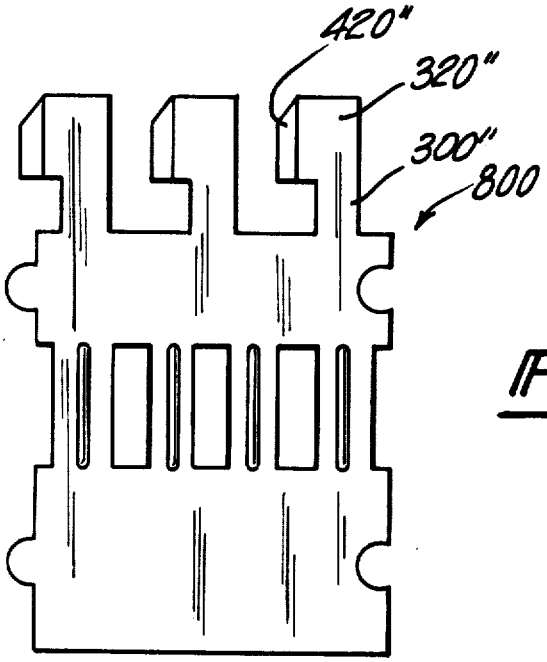
FIG. 9 shows a sheet metal blank for making the embodiment of FIG. 8.

Another embodiment of the invention is shown in FIGS. 8 and 9. In this embodiment, a contact 100 is the same as contact 10 except that it has three contact fingers instead of four. FIG. 8 is a fragmentary view showing identical contacts 100 and 100′ in mating engagement with the respective fingers 300 and 300′ in an interdigitated relationship. FIG. 9 shows a contact blank 300 which is stamped from sheet metal for forming the contact 100. It is noted that the blank with three contact fingers 300″ affords more space for blanking and forming the bevelled edges 420″ on the blades 320″. A contact with three contact fingers will have a lower insertion force and less contact area than a similar contact with four fingers.

Although the description of this invention has been given with reference to a particular embodiment, it is not to be construed in a limiting sense. Many variations and modifications will now occur to those skilled in the art. For a definition of the invention reference is made to the appended claims.

What is claimed is:

1. A method of making an electrical connector assembly of the type including a dielectric housing having a passage therethrough for receiving a hermaphroditic electrical contact comprised of a tubular body, the steps including:

providing a plurality of radially spaced, longitudinally extending engagement fingers on a forward end portion of the tubular body, each finger including at its distal end portion an offset blade portion;

bending said offset blade portions radially inwardly so that ends converge towards but do not reach the central axis of the tubular body;

forming generally U-shaped locking shoulders medially around the tubular body, said shoulders cooperating to allow said tubular body to undergo longitudinal compression;

forming a number of retention shoulders on said dielectric housing for mounting the contact within the passage, each adjacent pair of retention shoulders being separated by a slot and the number of retention shoulders being equal in number to the number of locking shoulders, each retention shoulder being formed with a tapered entry ramp leading to a groove sized to receive one said locking shoulder;

fitting the tubular body into the passage so that the locking shoulders fit between the slots and are disposed adjacent to the entry ramps; and twisting the body so that the locking shoulder is forced up the ramp and into the groove.

* * * * *